US009510643B2

(12) United States Patent
Blum

(10) Patent No.: US 9,510,643 B2
(45) Date of Patent: Dec. 6, 2016

(54) SPORT ORTHOTICS

(76) Inventor: Jonathan A. Blum, Orlando, FL (US)

( * ) Notice: Subject to any disclaimer, the term of this patent is extended or adjusted under 35 U.S.C. 154(b) by 38 days.

(21) Appl. No.: 13/416,622

(22) Filed: Mar. 9, 2012

(65) Prior Publication Data

US 2013/0232814 A1 Sep. 12, 2013

(51) Int. Cl.
*A43B 13/38* (2006.01)
*A43B 7/14* (2006.01)

(52) U.S. Cl.
CPC ..... *A43B 7/142* (2013.01); *A43B 7/144* (2013.01); *A43B 7/149* (2013.01); *A43B 7/1465* (2013.01)

(58) Field of Classification Search
CPC ..... A43B 7/149; A43B 7/1465; A43B 7/144; A43B 7/142
USPC ..... 36/142, 143, 144, 145, 37, 92, 91, 127,36/130, 25 R, 34 R, 69, 82, 166, 173, 103, 174
See application file for complete search history.

(56) References Cited

U.S. PATENT DOCUMENTS 797,243 A * 8/1905 Waite ..... 36/37
873,722 A * 12/1907 Cohen ..... 36/37
1,242,363 A * 10/1917 Mueller ..... 36/173
1,606,187 A * 11/1926 Scholl ..... A43B 21/32 36/37
1,864,999 A * 6/1932 Gluckman ..... 36/176
1,973,402 A * 9/1934 Bohmbach ..... 36/173
2,119,807 A * 6/1938 Farley ..... 36/141
2,255,100 A * 9/1941 Brady ..... A43B 21/32 36/173
2,847,769 A * 8/1958 Schlesinger ..... 36/127
3,545,447 A * 12/1970 Silverman ..... 36/142
4,316,333 A * 2/1982 Rothschild ..... 36/50.1
4,530,173 A * 7/1985 Jesinsky, Jr. ..... 36/92
4,682,425 A 7/1987 Simmons
4,685,227 A * 8/1987 Simmons ..... 36/127
4,953,311 A * 9/1990 Bruggemeier ..... 36/127
5,154,173 A * 10/1992 Aultman ..... A43B 7/14 128/DIG. 21
5,212,894 A * 5/1993 Paparo ..... 36/43
5,282,326 A * 2/1994 Schroer, Jr. ..... A43B 17/023 36/145
5,842,294 A * 12/1998 Fabricant ..... 36/127
D408,120 S * 4/1999 Fair ..... D2/961
6,460,275 B1 * 10/2002 Bennett et al. ..... 36/144
6,973,743 B1 * 12/2005 Mowery ..... 36/43
7,458,173 B2 12/2008 Kielt et al.
7,793,430 B2 9/2010 Ellis
7,921,580 B2 4/2011 Russell
2003/0005599 A1 1/2003 Panaccione
2004/0194344 A1 * 10/2004 Tadin ..... 36/44
(Continued)

*Primary Examiner* — Jila M Mohandesi
*Assistant Examiner* — Katharine Gracz
(74) *Attorney, Agent, or Firm* — Akerman LLP

(57) ABSTRACT

A pair of sport shoe inserts may be shaped differently to provide support to different areas of the feet during movement while participating in a sporting event. The right, back corner of the right foot may be supported by a lateral flange having an inclined slope that declines inwardly and forwardly. The left, back corner of the left heel may be supported with a lateral flange having an inclined slope that declines inwardly and forwardly, but at a smaller degree than with the right heel. The right heel may have a medial area that is uncovered or unsupported, such as to allow the right ankle to roll during a swing or other movement. The left heel may have a medial area that is supported with an arch or other support that may provide for push off during a swing or other player movement.

13 Claims, 16 Drawing Sheets

(56) References Cited

U.S. PATENT DOCUMENTS

| | | | | |
|---|---|---|---|---|
| 2005/0108899 | A1* | 5/2005 | Kielt et al. | 36/71 |
| 2007/0074430 | A1 | 4/2007 | Coomer | |
| 2007/0084084 | A1* | 4/2007 | Rich | 36/44 |
| 2008/0083140 | A1 | 4/2008 | Ellis | |
| 2008/0086909 | A1 | 4/2008 | Raspini | |

* cited by examiner

SPORT ORTHOTICS

FIELD OF THE INVENTION

The present application relates to orthotics, and more particularly to orthotics for use during sporting events or other activity involvement physical movement.

BACKGROUND

Conventional orthotic inserts and insoles include those disclosed by U.S. Pat. No. 7,458,173 (entitled "Orthotic Insert and Method of Manufacturing Thereof"); U.S. Pub. No. 2008/0086909 (entitled "Insole for Sports Shoes, Particularly for Golf"); U.S. Pat. No. 5,842,294 (entitled "Golf Orthotic"); U.S. Pat. No. 4,953,311 (entitled "Golf Shoes and Inserts for Golf Shoes"); U.S. Pat. No. 4,682,425 (entitled "Adapters for Golf Shoes"); U.S. Pub. No. 2007/0074430 (entitled "Orthotic Device"); U.S. Pub. No. 2003/0005599 (entitled "Modular Cushioned Insole Support System"); U.S. Pat. No. 7,793,430 (entitled "Removable Rounded Midsole Structure and Chambers With Computer Processor-Controlled Variable Pressure"); U.S. Pub. No. 2008/0083140 (entitled "Devices With Internal Flexibility Sipes, Including Siped Chambers for Footwear"); and U.S. Pat. No. 7,921,580 (entitled "Sole Construction for Energy Storage and Rebound").

However, conventional inserts may have various drawbacks, such as providing inadequate support during player movement. Conventional inserts may also lead to injuries, and have limited flexibility or other deficiencies.

SUMMARY

A pair of sport shoe inserts may be provided. The right and left foot inserts may be shaped differently to provide support to different areas of a player's feet while the player is participating in a sporting event. The lateral (or outer) area of the right heel may be supported with an inclined slope or surface of the right foot insert that declines inwardly and/or forwardly. The lateral (or outer) area of the left heel may be supported with an inclined slope or surface of the left foot insert that declines inwardly and/or forwardly, but at the same or smaller angles than those of the right foot insert. The right foot insert may have a medial (or inner) area that is substantially or entirely uncovered or unsupported, such as to allow the right foot and/or ankle to roll or otherwise move freely during a swing or other player movement (assuming that the player is a right-handed hitter). The left foot insert may have a medial (or inner) area that provides support to the left foot with an arch that may provide for push off during a swing or other player movement (again assuming that the player is a right-handed hitter). Alternatively, the features of the right and left foot inserts may be switched for a left-handed hitter.

In one aspect, a pair of sport shoe inserts may be provided. The pair of sport shoe inserts may include a right insert configured to partially support a right foot. The right insert may have a right lateral flange and a heel cup. The right lateral flange may be configured to primarily support, or even only support, approximately a right, back half of the right foot and/or heel when viewed from above, and may extend from the back of the right heel or heel cup in a forward direction until approximately a base of a fifth metatarsal is reached such that a forefoot area of the right foot is not supported by the right insert. The right lateral flange may optionally be configured to be at a diagonal or other angle when viewed from above and moving from the back of the right heel toward the base of the fifth metatarsal. The right lateral flange may further have a first constant downward slope moving in a lateral (outside) to medial (inside) direction, and a second constant downward slope moving from the back of the right heel toward the base of the fifth metatarsal. On a left or inner half of the right foot when viewed from above, the right insert and/or heel cup may not extend past approximately the front of the right ankle to provide a cleared medial area for the right foot that facilitates unhindered follow through and rolling movement of the right foot and/or ankle during a swing or other player movement. The pair of golf shoe inserts may include a left insert configured to partially support a left foot. The left insert may have a left lateral flange, a heel cup, and a medial arch. The left lateral flange may be configured to primarily support, or even only support, approximately a left, back half of the left foot and/or heel when viewed from above. The left lateral flange may extend from the back of the left heel or heel cup in the forward direction at a diagonal or other angle, and have a third constant downward slope moving in a lateral (outside) to medial (inside) direction, and a fourth constant downward slope moving forward from the back of the left heel toward the toes. Both the right lateral flange and the left lateral flange, and respective downward slopes, facilitate moving weight of a player onto the balls of the right foot and the left foot, respectively, and improve the balance of the player during a swing or other player movement.

In another aspect, a right shoe insert may be provided. The right shoe insert may be configured to partially support a right foot and/or a right heel. The right insert may have a right lateral flange and a heel cup. The right lateral flange may be configured to primarily support, or even only support, approximately a right half (or outer portion) of the right foot and/or heel when viewed from above, and may extend from the back of the right heel or heel cup in a forward direction until approximately a base of a fifth metatarsal is reached such that a forefoot area of the right foot is not supported by the right insert. The right lateral flange may also be configured to be angled when viewed from above with respect to the longitudinal axis of the right shoe insert and moving from the back of the heel cup toward the base of the fifth metatarsal. The right lateral flange may further have a first constant downward slope moving in a lateral to medial direction, and a second constant downward slope moving from the back of the right heel toward the base of the fifth metatarsal. On the left half (or inner portion) of the right foot when viewed from above, the right insert and/or heel cup may not extend past approximately the front of the right ankle to provide a cleared medial area for the right foot that facilitates unhindered follow through and rolling movement of the right foot and/or ankle during a swing or other movement by a player. The right lateral flange and downward slope(s) may facilitate moving the weight of the player onto the balls of the right foot, and improve the balance of the player during a swing or other player movement.

In another aspect, a left shoe insert may be provided. The left shoe insert may be configured to partially support a left foot and/or a left heel. The left insert may have a left lateral flange, a heel cup, and a medial arch. The left lateral flange may be configured to primarily support, or even only support, approximately the left half (or outer portion) of the left foot and/or heel when viewed from above. The left lateral flange may extend from the back of the left heel or heel cup in the forward direction at an angle, and have a first constant downward slope moving in a lateral to medial direction, and a second constant downward slope moving forward from the back of the left heel toward the toes. The left lateral flange and downward slope(s) may facilitate moving the weight of the player onto the balls of the left foot, and improve the balance of the player during a swing or other player movement.

Advantages of the present invention will become more apparent to those skilled in the art from the following description of the preferred embodiments which have been shown and described by way of illustration. As will be realized, the invention is capable of other and different embodiments, and its details are capable of modification in various respects. Accordingly, the drawings and description are illustrative in nature and not restrictive.

BRIEF DESCRIPTION OF THE DRAWINGS

There are shown in the drawings arrangements which are presently discussed, it being understood, however, that the invention is not limited to the precise arrangements and instrumentalities shown, wherein.

DETAILED DESCRIPTION OF THE INVENTION

Figure 1:
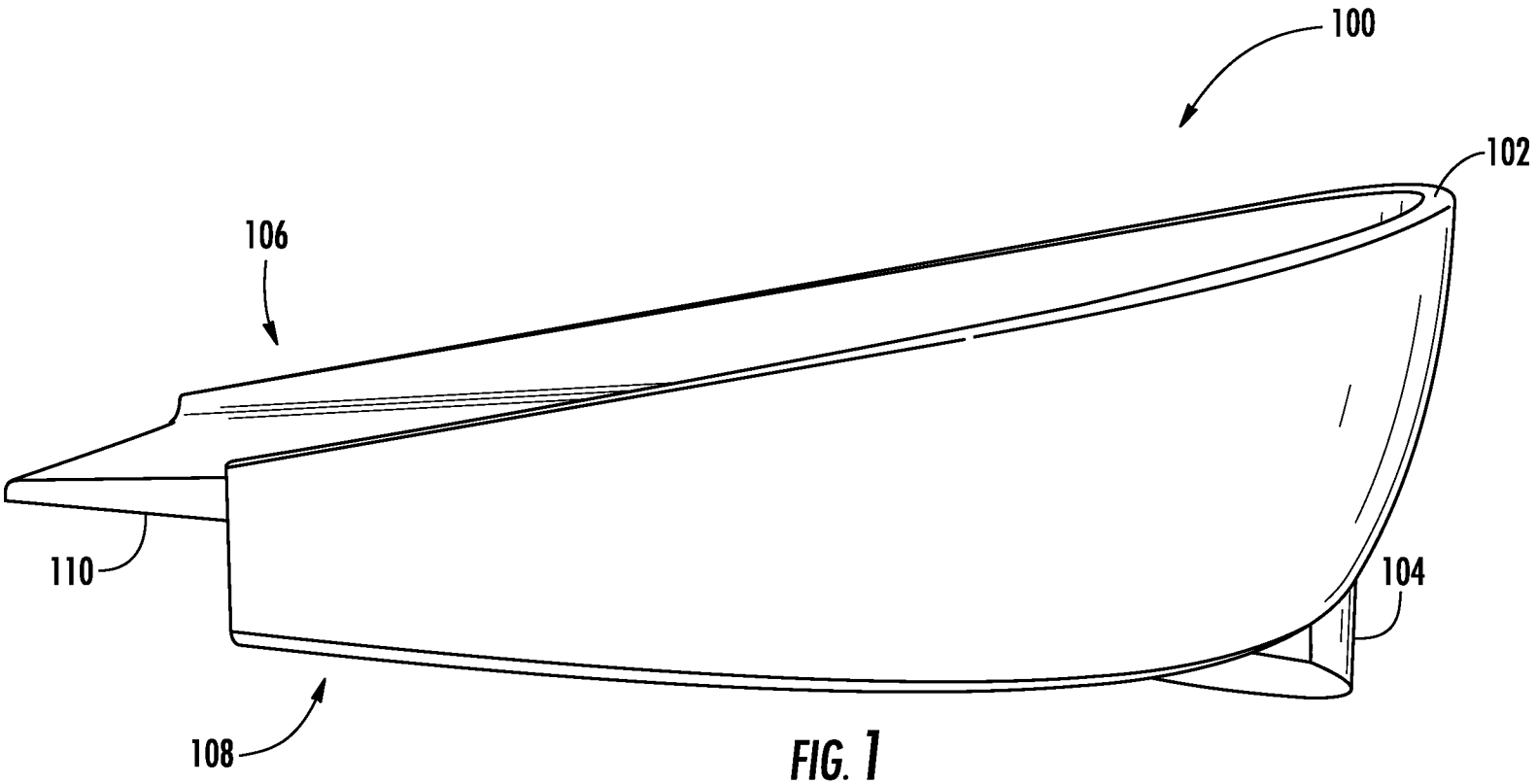
FIG. 1 depicts a perspective view of an exemplary right shoe insert.

The exemplary embodiments of the present disclosure describe a pair of orthotic shoe inserts. The orthotic shoe inserts may be used during various sporting events or other activities involving physical movement, such as movement of the feet, legs, toes, ankles, and other body parts. The orthotic shoe inserts may function as a training aid, and allow for injury prevention and/or recovery. The orthotic shoe inserts may also enhance performance during a sporting event, such as golf, baseball, softball, racquetball, tennis, football, basketball, and other sports. The insert devices may be made from silicone, TPU (Thermoplastic Polyurethanes), EVA (Ethylene Vinyl Acetate) or other suitable materials and may be sized to readily fit in all sporting shoe wear.

In one aspect, the orthotic shoe inserts may be used with golf shoes and while a player is playing golf. With golf, each foot may perform differently during a swing and with a different pattern of pressure distribution. As a result, each shoe may need a different modification of orthotic. Therefore, the left and right foot orthotic of the present embodiments may be constructed differently based upon measured differences in kinematics and the kinetics associated with each foot during a game of golf or other sporting event.

The orthotics may also function as a teaching aid regarding proper foot positioning during a sporting event. For example, with the present golf orthotic embodiments, during a swing that is similar to golf club swing aids, the orthotics may help to develop a swing that may be consistently repeated. The orthotics may improve function and performance due to improving balance effects on closed chain kinetics, and thus increase club head velocity and promote greater efficiency during a swing. Research has shown that optimizing patterns of rotation and weight transfer may facilitate the segmental and kinematic linking necessary to perform an efficient, accurate and reproducible golf swing, resulting in a lower risk of injury.

The insert devices may each be a single integrated piece or alternatively comprise a number of individual or distinct components, such as six components, which may include a heel cup, a lateral flange, a medial arch, a bottom, and other components for each insert. The multiple components may work in unison throughout all phases of a swing or other movement, and may increase stability, efficiency, club head velocity, and ground reactive forces. As a result, a player may experience greater driving distance and consistency in hitting the sweet spot, resulting in less fade or slice.

Additionally, every great swing has a starting point or setup, which may place the golfer in an optimal position to execute a reproducible golf swing and ball impact. The inserts may guide both feet into that starting point. The inserts may also facilitate correct technique that may reduce the risk of injury by keeping the spine vertical, avoid the reverse C position, and eliminate excessive external rotation of the leading leg and knee (which may increase the potential for damaging hyperextension of the knee).

I. Exemplary Orthotic Insert Features

The right and left shoe orthotic inserts may have several features. For instance, the right shoe insert may have a right lateral flange that supports the right foot. The right lateral flange may primarily support the outer (lateral) and back heel area of the right foot. The right lateral flange may extend forward from the back of the right heel at approximately a 20 degree or other downward angle to approximately the fifth styloid to stabilize and support the calcaneal-cuboid joint and relieve the peroneal tendons, and thus increase proximal stability of the rear foot.

With the golf orthotics of the present embodiments, the right lateral flange may increase push off and allow the right foot to act as a "driver," accelerating the body's center of mass to the left during a downswing. The right lateral flange may effectively act as an artificial "bank" from which to hit from, and may extend to the base of fifth metatarsal, or the vicinity thereof, to allow for laterally directed forces to be generated over a wider area of the right shoe. This "loading" of weight transfer may create more momentum on downswing and weight may collect on the inside of the right foot and not on the outside. An improper weight shift may fail to maintain the center of pressure near the midpoint of the shoe and may challenge a golfer's ability to "square up" at impact. The "loading" may increase ground reactive forces to increase drive distance, while the "bank" may prevent excessive lumbar twist.

The right shoe insert may also have little, or preferably no, medial heel and/or medial flange. The lack of a medial heel and medial flange may allow the player to have an unhindered, or substantially unhindered, follow through, and facilitate and support rolling movement of the right foot and/or ankle.

Both the right and left shoe inserts may have a deep heel cup that surrounds, or substantially surrounds, the entire back and sides of the respective heels. The deep heel cup may provide for stability by helping to promote greater proximal stability to the rear foot. The deep heel cup may be approximately 0.8 inches (or 20 mm) deep in one embodiment. Other dimensions may be used.

Both the right and left shoe inserts may include a raised and tapered heel to toe dimension. A tapering down from the heel distally by approximately 0.08 inches (or 2 mm) or other amounts may put more weight onto the balls of the feet to place the feet in a proper approach alignment. The raised and tapered heel of the inserts may also increase traction while maintaining comfort, and provide additional surface area for forces to act upon. The inserts may promote ease of walking, and facilitate comfortable setup position(s), such as for a golf swing. The inserts may also encourage the head of the player to slide slightly from the left to the right, but not from the front to the back.

The left shoe insert may have a left lateral flange supporting, or primarily supporting, the outer heel portion or left rear half of the left foot. With the golf orthotics of the present embodiments, the left shoe insert may increase stability on follow through. At impact, such as when a golf club meets a ball, vertical and shear forces may push laterally on the ground. To facilitate shear forces, the left shoe insert may include the left lateral flange component to push against.

The time of impact is a time of great instability for the left foot—with center pressure shifted laterally and axial torque being exerted on the whole lower extremity. Continued movement of the body's center of gravity toward the flag may lead to the inversion of the ankle. These forces (lateral column overload) may contribute to excessive external rotation of the leading leg and knee with increased potential for damaging hyperextension of the knee. The instability of the overload may also lead to the reverse C position of the back and inconsistencies at impact. As a result, the left lateral flange may provide the stability on follow through to prevent the potential for injury and to improve performance.

The left shoe insert may also include a medial arch support that supports the inner portion or arch of the left foot. The medial arch support may provide greater contact area between the left foot and the ground on backswing and follow through. On backswing, the left side of the left foot may undergo internal tibial rotation, and foot pronation may occur. If internal tibial rotation is limited, the left heel may leave the ground, indicating stress on the left leg. The medial arch component supports this pronation and internal tibial rotation with increased contact and supporting surface area. The medial arch support may also achieve this effect as the left foot/ankle supinates in follow through by acting as a supporting surface.

II. Exemplary Embodiments

The present embodiments may relate to golf or other orthotic insoles or inserts. The right and left foot inserts may be different, as shown in the Figures. The inserts shown may be for a right-handed swinger or batter. One of ordinary skill in the art would recognize that the features of each insert may be interchangeable and reconfigured to support a left-handed swinger or batter. For instance, the features of the exemplary right foot insert may be used with a left foot insert, and the features of the exemplary left foot insert may be used with a right foot insert.

Generally, in one aspect, a pair of golf or other shoe inserts may be provided. The pair of shoe inserts may include a right insert configured to partially support a right foot, such as primarily supporting the outer or lateral portion of the back or heel area of the right foot. The right insert may have a heel cup that surrounds, or substantially surrounds, the right heel. The heel cup may be interconnected with a right lateral flange. The right lateral flange may be configured to primarily support, or even only support, an outer portion or the right half of the right foot, and/or the back or heel area of the right foot, when viewed from above. The right lateral flange may extend from the back of the right heel in a forward direction until approximately a base of a fifth metatarsal is reached such that a forefoot area of the right foot is not supported by the right insert.

The right lateral flange may be configured to have a narrowing taper and/or be configured to be angled (with respect to the longitudinal axis of the right shoe insert) when viewed from above and moving from the back of the right heel toward the base of the fifth metatarsal. The angle may be at a medial to lateral side slope, and move the right lateral flange in a direction such that the right lateral flange supports less and less of the medial area moving forward from the back of the right heel. The right lateral flange may further have a first constant downward slope moving in a lateral to medial direction, and a second constant downward slope moving from the back of the right heel toward the base of the fifth metatarsal. On a left half of the right foot when viewed from above, the right insert may not extend past approximately the front of the right ankle to provide a cleared medial area for the right foot and/or ankle that facilitates unhindered follow through and rolling movement of the right foot and/or ankle during a golf swing or other player movement.

The pair of shoe inserts may include a left insert configured to partially support a left foot, such as primarily supporting the outer portion of the back or heel area and the inner portion of the medial arch area. The left insert may have a heel cup that surrounds, or substantially surrounds, the left heel, such as the left and right sides and the back of the heel. The left insert may also have a left lateral flange and a medial arch interconnected with the heel cup. The left lateral flange may be configured to primarily support, or even only support, an outer portion or the left half of the left foot when viewed from above. The left lateral flange may extend from the back of the left heel in the forward direction, such as at an angle or a narrowing taper. The left lateral flange may have a third constant downward slope moving in a lateral to medial direction, and a fourth constant downward slope moving from the back of the left heel in the forward direction toward the toes.

Both the right lateral flange and the left lateral flange may facilitate moving the weight of a golfer onto the balls of the right and left feet, respectively, and improve the balance of the golfer during a golf swing. In one embodiment, the first constant downward slope (of the right lateral flange of the right insert) moving in a lateral to medial direction may be approximately 20 degrees downward. The second constant downward slope (of the right lateral flange) moving from the back of the right heel toward the fifth metatarsal may cover approximately 0.08 inches (2 mm) in a downward direction. The third constant downward slope (of the left lateral flange of the left insert) moving in a lateral to medial direction may be approximately 10 degrees downward. The fourth constant downward slope (of the left lateral flange) moving from the back of the left heel in a forward direction may cover approximately 0.08 inches (2 mm) in a downward direction. Other degrees and dimensions may be used.

A. Exemplary Right Foot Insert

FIG. 1 depicts a perspective view of an exemplary right shoe insert 100. The right shoe insert 100 may include a right heel cup 102, a right lateral flange 104, a lateral or outer half 106, and a medial or inner half 108. The right shoe insert may include additional, fewer, or alternate components.

The right shoe insert 100 may include a heel cup 102 that is configured to be heel shaped. The heel cup 102 may surround and provide support to the right heel, such as to the left and right sides and the back of the right heel.

The right lateral flange 104 may primarily support approximately the lateral half 106 of the right foot, and provide little support to the medial half 108. The right lateral flange 104 may provide support to the medial half 108 near the back of the right heel. However, the right lateral flange 104 may be angled such that moving forward, the right lateral flange 104 no longer supports the medial half 108 of the right foot.

The forward end of the lateral half 106 may extend past the forward end of the medial half 108 to provide a clear or unsupported medial area 110 of the right foot during use. The lateral (outer) half 106 may extend beyond the right side of the right ankle and along the outside of the right foot. In one embodiment, the lateral half 106 may extend up to approximately the base of the $5^{th}$ metatarsal, or in the vicinity thereof. On the other hand, the medial (inner) half 108 may extend only to the vicinity of the left side of the right ankle, such as to approximately the front of the left or inward side of the right ankle, slightly forward of the right ankle, or to about the mid-point of the right ankle.

In one embodiment, the right insert 100 may be approximately 2.6 inches wide, the lateral half 106 may have a longitudinal length of approximately 4.0 inches, and the medial half 108 may have a longitudinal length of approximately 2.5 inches. As a result, the lateral half 106 may extend beyond the medial half 108 by approximately 1.5 inches. Other dimensions may be used.

Figure 2:
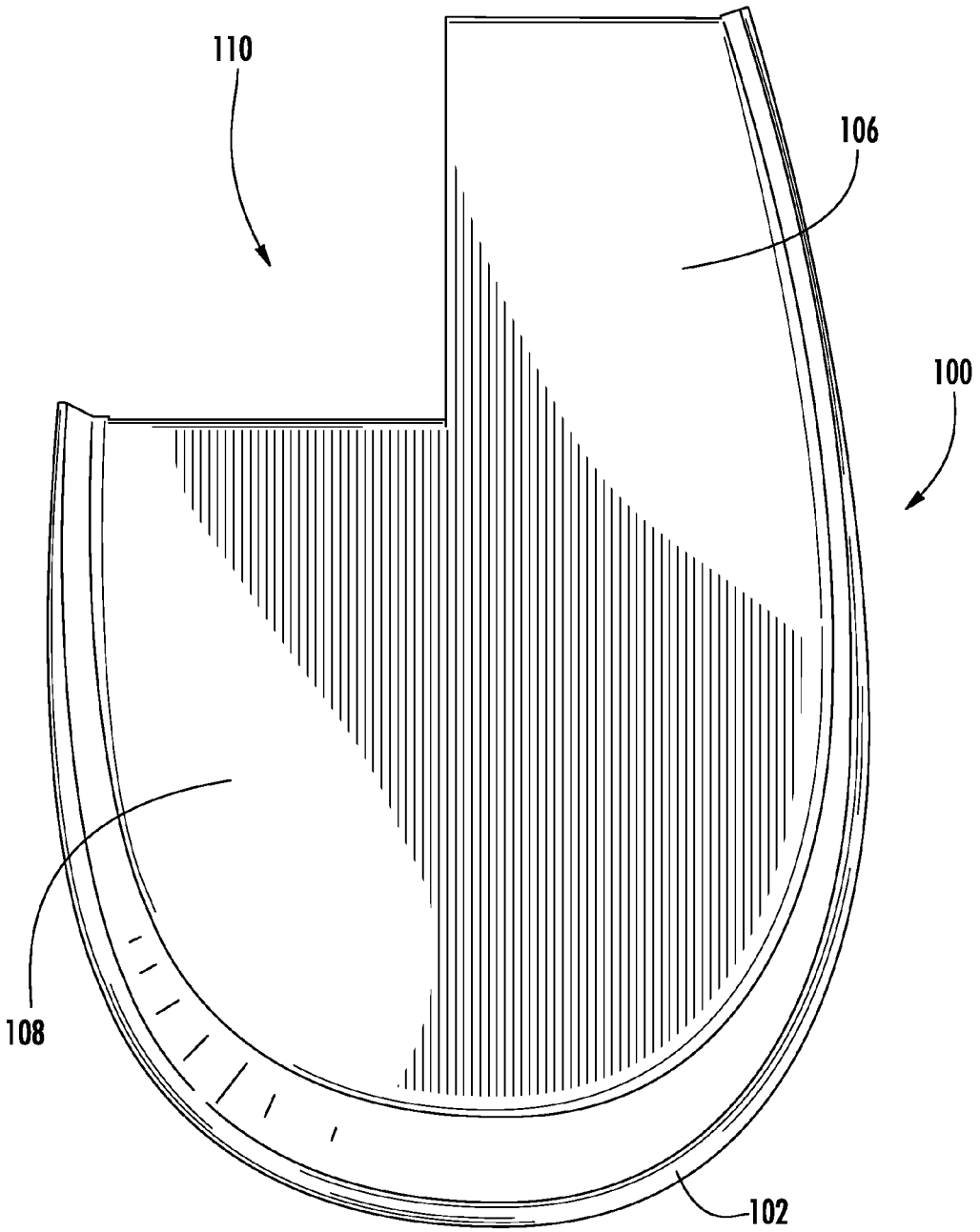
FIG. 2 depicts a top view of the exemplary right shoe insert.

FIG. 2 depicts a top view of the exemplary right shoe insert 100. The heel cup 102 may be a thin and firm edge or ledge that surrounds and supports the heel of the right foot. As shown, the forward end of the lateral or outer half 106 may extend in the forward direction past the medial or inner half 108. The lateral half 106 and medial half 108 may be configured to provide for a cleared medial area 110 that may facilitate right foot and/or ankle movement during a sporting event.

Figure 3:
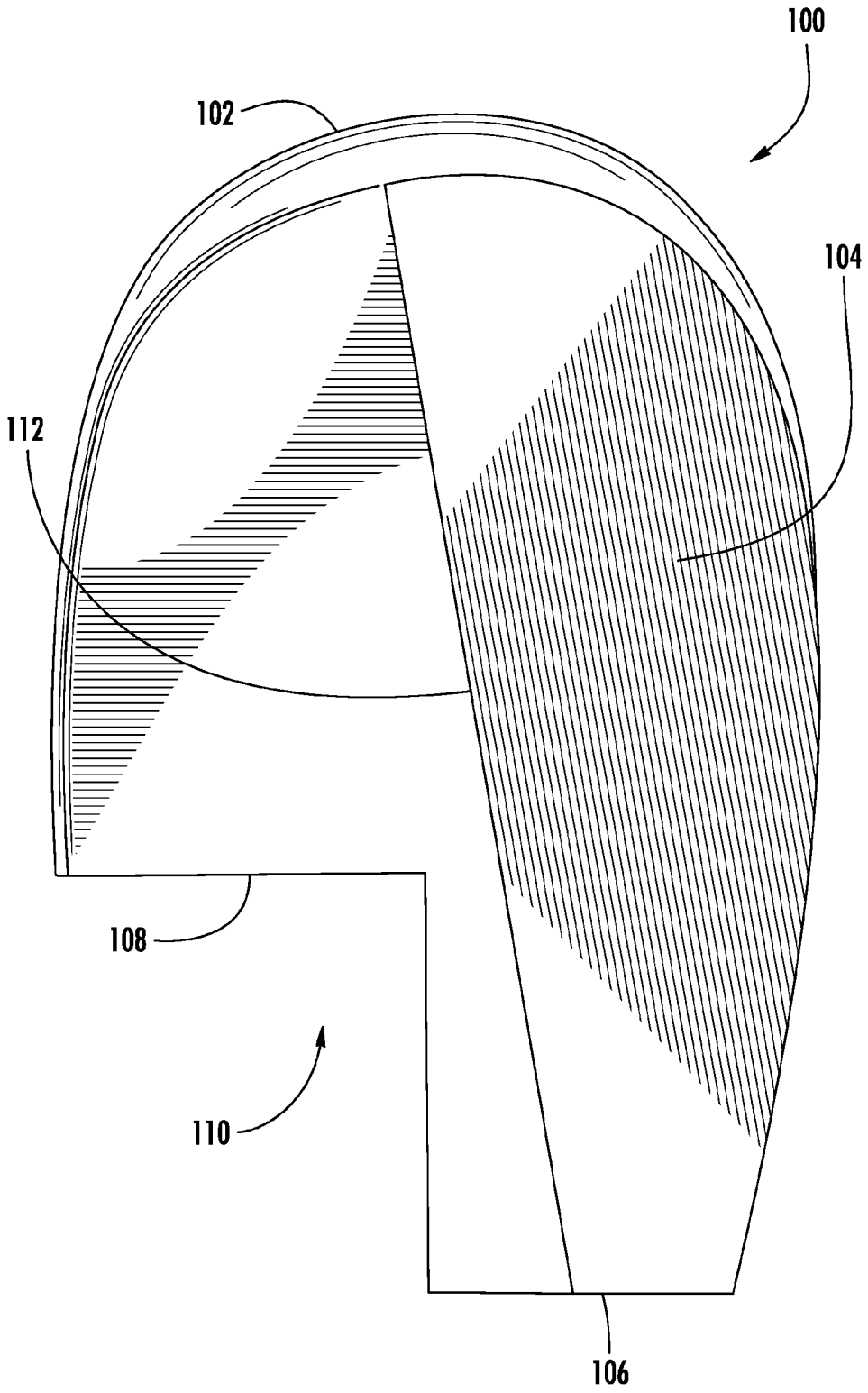
FIG. 3 depicts a bottom view of the exemplary right shoe insert.

FIG. 3 depicts a bottom view of the exemplary right shoe insert 100. The heel cup 102 may extend upward from the bottom of the right shoe insert 100. The heel cup 102 may have a maximum height of between approximately 0.1 and approximately 1.5 inches, preferably approximately 0.8 inches, at the back of the right heel. The height of the heel cup 102 may lessen moving from the back of the right heel forward. For instance, the height of the heel cup on the inside of the right foot may be substantially less than that on the outside of the right foot, or even approximately zero. Other heights may be used. Again, the lateral half 106 may extend for a longer longitudinal length than the medial half 108 to create the cleared medial area 110.

The right lateral flange 104 may primarily support approximately half of the right foot, such as approximately the right or outer half of the right foot, or approximately the right, back corner of the right foot. The right lateral flange 104 may be wedge-shaped. The right lateral flange 104 may be angled, tapered or narrowing moving from the back of the heel cup or heel portion 102 toward the toes, and at various angles. For instance, the right lateral flange 104 may have a taper or inclined slope 112 of approximately 10 degrees, 15 degrees, 20 degrees, 25 degrees or other angle with respect to the longitudinal axis of the right shoe insert when viewed from above.

Moving forward from the back of the right heel, the inclined slope 112 may move from the medial half 108 first toward and then into the lateral half 106. Once away from the back area of the right heel, the right lateral flange 104 may be entirely on the lateral half 106 and support the majority, but not the entirety, of the lateral half 106. For instance, a portion of the lateral half 106 in the forward most portion of the lateral half 106 may not be supported by the right lateral flange 104, as shown in FIG. 3. Alternatively, the inclined slope 112 may be at zero degrees and be parallel to the longitudinal axis of the right insert 100. For example, the inclined slope 112 may divide the right insert into the medial half 108 and the lateral half 106, and the right lateral flange 104 may only support all or part of the lateral half 106, but not support any portion of the medial half 108. Other configurations may be used.

The right lateral flange 104 may be downwardly inclined moving inwardly (i.e., moving from the outside of the right foot toward the middle) at an angle between approximately 10 degrees and approximately 30 degrees, preferably at approximately 20 degrees. Other inward inclines may be used. The right lateral flange 104 may be downwardly inclined moving forwardly (i.e., moving from the back of the heel cup 102 toward the front end of the lateral side 106) at an angle between approximately 1 degree and approximately 20 degrees. Preferably, the forward moving incline in a downward direction may cover approximately 0.08 inches vertically. Other forward inclines may be used. The inward and forward inclines may provide a wedge-shaped artificial bank from which to swing during game play.

Figure 4:
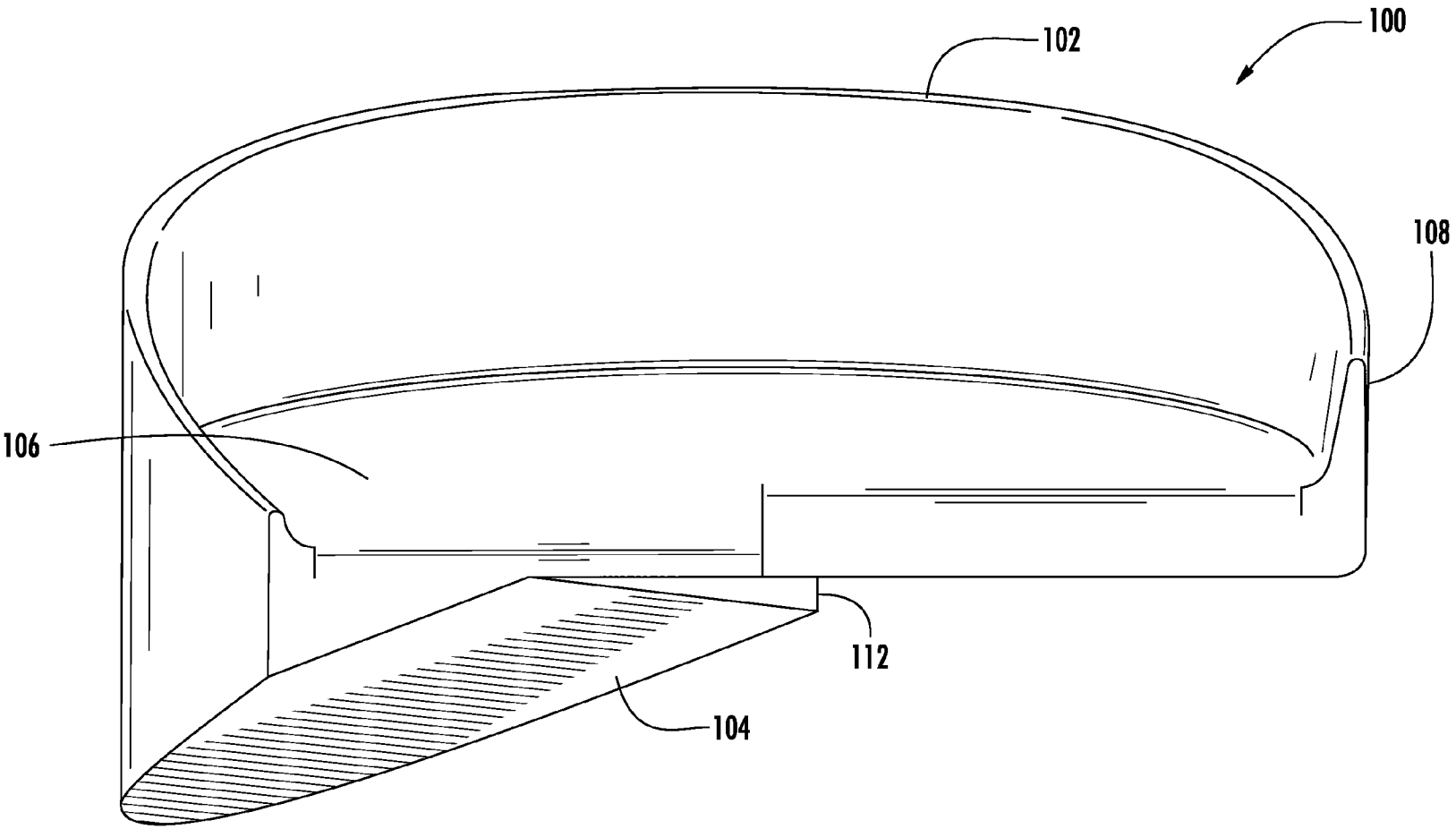
FIG. 4 depicts a front view of the exemplary right shoe insert.

FIG. 4 depicts a front view of the exemplary right shoe insert 100. The right lateral flange 104 may be angled or tapered to cut against the bottom of the right shoe insert 100 at an angle 112. The right lateral flange 104 may be inclined in a downward direction moving inward and/or be inclined in a downward direction moving forward, i.e. moving from the back of the heel cup 102 or right shoe insert 100 toward the front end of the lateral half 106.

Also, the top surfaces of both the lateral half 106 and the medial half 108 may be inclined in a downward direction moving from the back of the heel cup 102 or right shoe insert 100 toward the front ends of the lateral half 106 and medial half 108, respectively. For instance, the lateral half 106 and the medial half 108 may have inclined angles of between approximately 1 degree and approximately 25 degrees. Alternatively, the top of both the lateral half 106 and the medial half 108 may be flat or substantially flat.

In one embodiment, the back of the right heel cup 102 may have a vertical height of approximately 1.38 inches. Alternatively, the height of the right heel cup 102 may be sloped, such as being higher on the lateral side and lower on the medial side. For instance, the height of the right heel cup on the lateral side may be approximately 1.38 inches, and may slope down to a height of approximately 0.94 inches on the medial side (not shown). The lateral to medial downslope of the right lateral flange 104 may be approximately 20 degrees, and the right lateral flange 104 may have a lateral to medial width of approximately 1.3 inches. Alternate dimensions may be used.

The right lateral flange 104 may be a separate piece that is affixed to the right heel cup 102 and/or the lateral and medial halves 106, 108. Alternatively, the right shoe insert 100 may be manufactured as a single piece.

Figure 5:
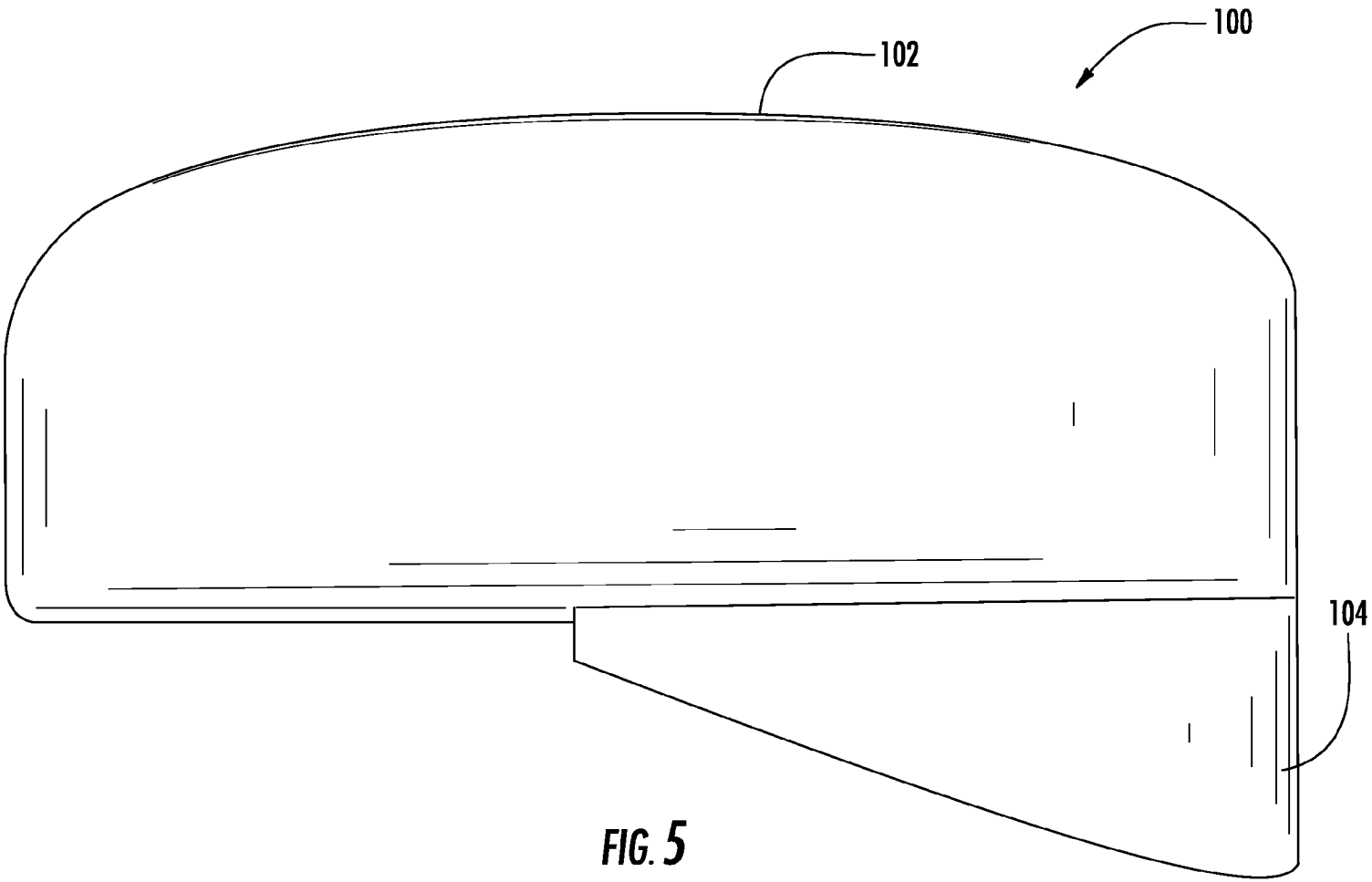
FIG. 5 depicts a back view of the exemplary right shoe insert.

FIG. 5 depicts a back view of the exemplary right shoe insert 100. The heel cup 102 may be sized to support a right heel of a player. The right lateral flange 104 may primarily, or even only, support approximately the right or outer half of the right foot and/or heel area, leaving the left half of the right foot and/or heel area substantially or entirely unsupported by the right lateral flange 104. The right lateral flange 104 may extend below the right heel cup 102 and have an incline or slope that runs into the heel cup 102.

Figure 6:
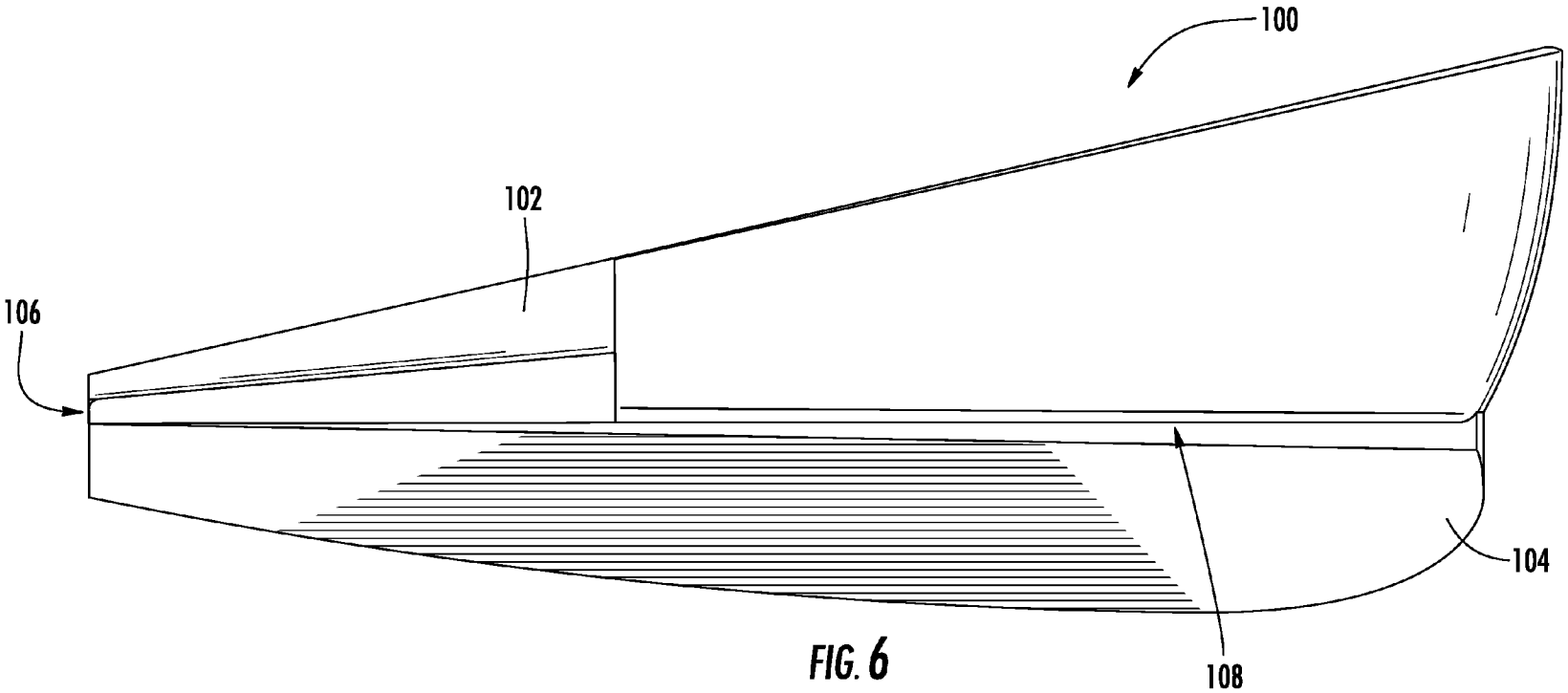
FIG. 6 depicts a left view of the exemplary right shoe insert.

FIG. 6 depicts a left view of the exemplary right shoe insert 100. The right side of the heel cup 102 and the forward end of the lateral half 106 may extend further forward than the left side of the heel cup 102 and the forward end of the medial half 108 to provide for a cleared medial area. The right lateral flange 104 may extend along the bottom of the entire lateral half 106 running in a forward or longitudinal direction.

Figure 7:
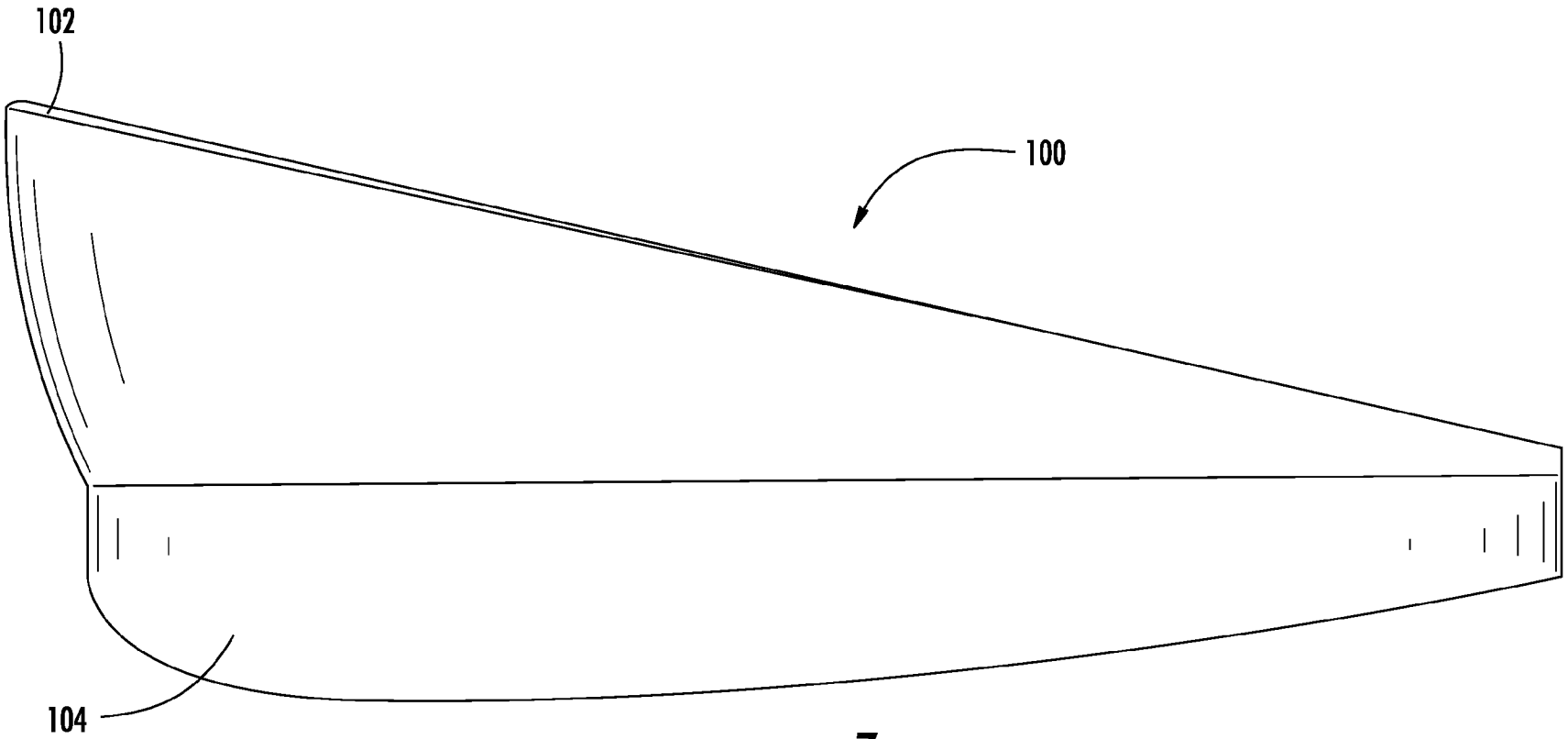
FIG. 7 depicts a right view of the exemplary right shoe insert.

FIG. 7 depicts a right view of the exemplary right shoe insert 100. The right lateral flange 104 may extend below and underneath of the right heel cup 102. The right lateral flange 104 and the right heel cup 102 may have the same or approximately the same longitudinal length.

In one embodiment, the right lateral flange 104 may have a longitudinal length of approximately 4.0 inches. At the back of the right heel, the right lateral flange 104 may have a vertical height or thickness of approximately 0.45 inches, and the front of the right lateral flange 104 may have a vertical height or thickness of approximately 0.08 inches. The heel cup 102 at the back of the right heel may have a vertical height of approximately 0.93 inches, such that from the bottom of the right lateral flange 104 to the top of the back of the heel cup 102 may be approximately 1.38 inches. Other dimensions may be used.

B. Exemplary Left Foot Insert

Figure 8:
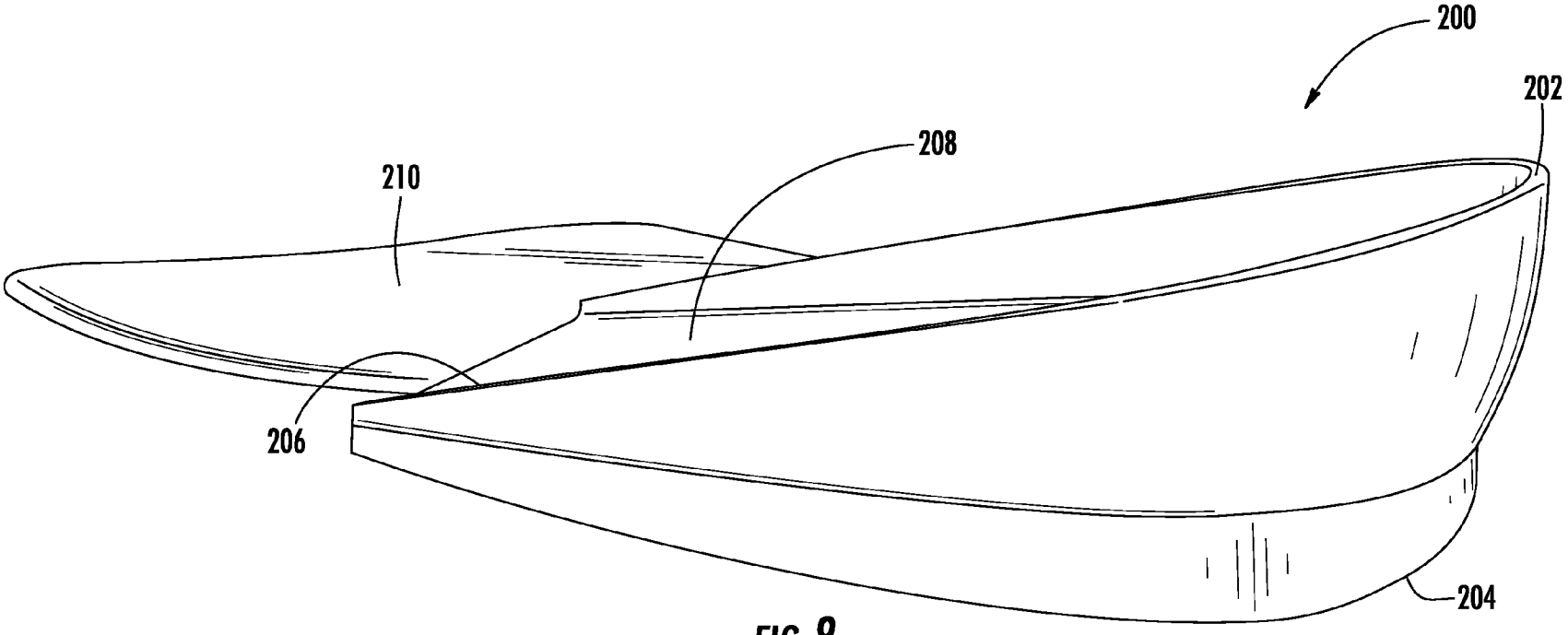
FIG. 8 depicts a perspective view of an exemplary left shoe insert.

FIG. 8 depicts a perspective view of an exemplary left shoe insert 200. The left shoe insert 200 may include a left heel cup 202, a left lateral flange 204, a lateral or outer half 206, a medial or inner half 208, and a medial arch portion 210. The left shoe insert may include additional, fewer, or alternate components.

The left heel cup 202 may surround, or substantially surround, and support the left heel of a player. The heel cup 202 may extend vertically to support the left heel area and run around both the lateral half 206 and the medial half 208. The left lateral flange 204 may extend below and underneath of the heel cup 202. The medial arch portion 210 may extend in a forward direction from the medial half 208.

Figure 9:
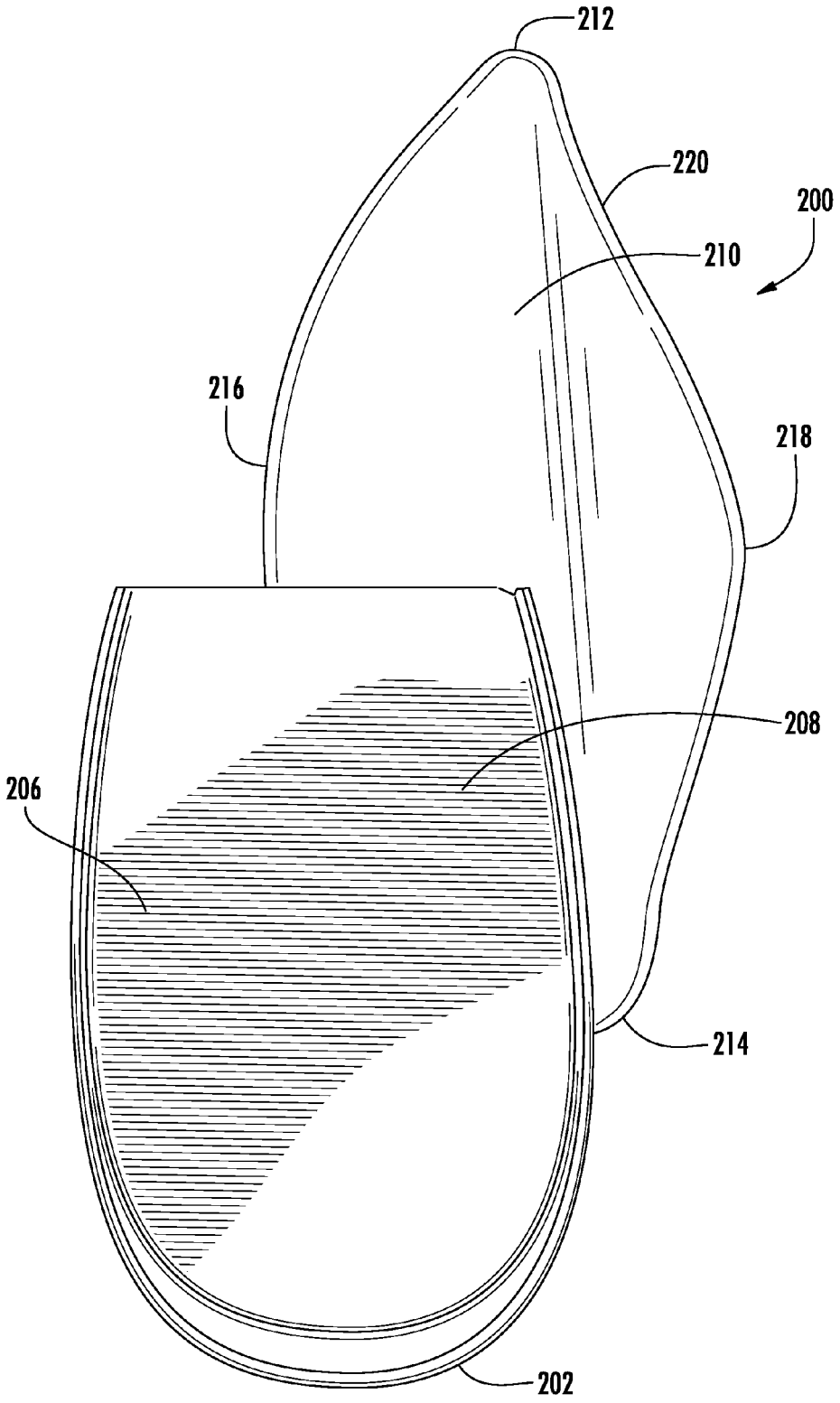
FIG. 9 depicts a top view of the exemplary left shoe insert.

FIG. 9 depicts a top view of the exemplary left shoe insert 200. The left heel cup 202 may extend around both the lateral and medial halves 206, 208 of the left shoe insert 200. The medial arch portion 210 may extend in a forward direction primarily from the medial half 208. The medial arch portion 210 may provide arch support for the inner portion of the left foot during use, and may extend inwardly of both the left heel cup 202 and the medial half 208.

The medial arch portion 210 may be a separate piece that is affixed to the left heel cup 202 and/or the lateral and medial halves 206, 208. The left lateral flange may also be a separate piece that is affixed to the left heel cup 202 and/or the lateral and medial halves 206, 208. Alternatively, the left shoe insert 200 may be manufactured as a single piece.

In one embodiment, the medial arch portion 210 may have a top surface 212, a bottom surface 214, a left surface 216, a right surface 218, and a top right surface 220. The surfaces 212, 214, 216, 218, 220 may include concave and convex surfaces. For instance, the top or forward most surface 212 may have an outwardly extending curved surface with a radius of approximately 0.5 inches. The bottom or rear most surface 214 may have an outwardly extending curved surface with a radius of approximately 0.5 inches. The left or outer most surface 216 may have an outwardly extending curved surface with a radius of approximately 3.14 inches. The right or inner most surface 218 may have an outwardly extending curved surface with a radius of approximately 1.5 inches. The top right surface 220 may have an inwardly extending curved surface with a radius of approximately 6.66 inches. Other dimensions may be used.

Figure 10:
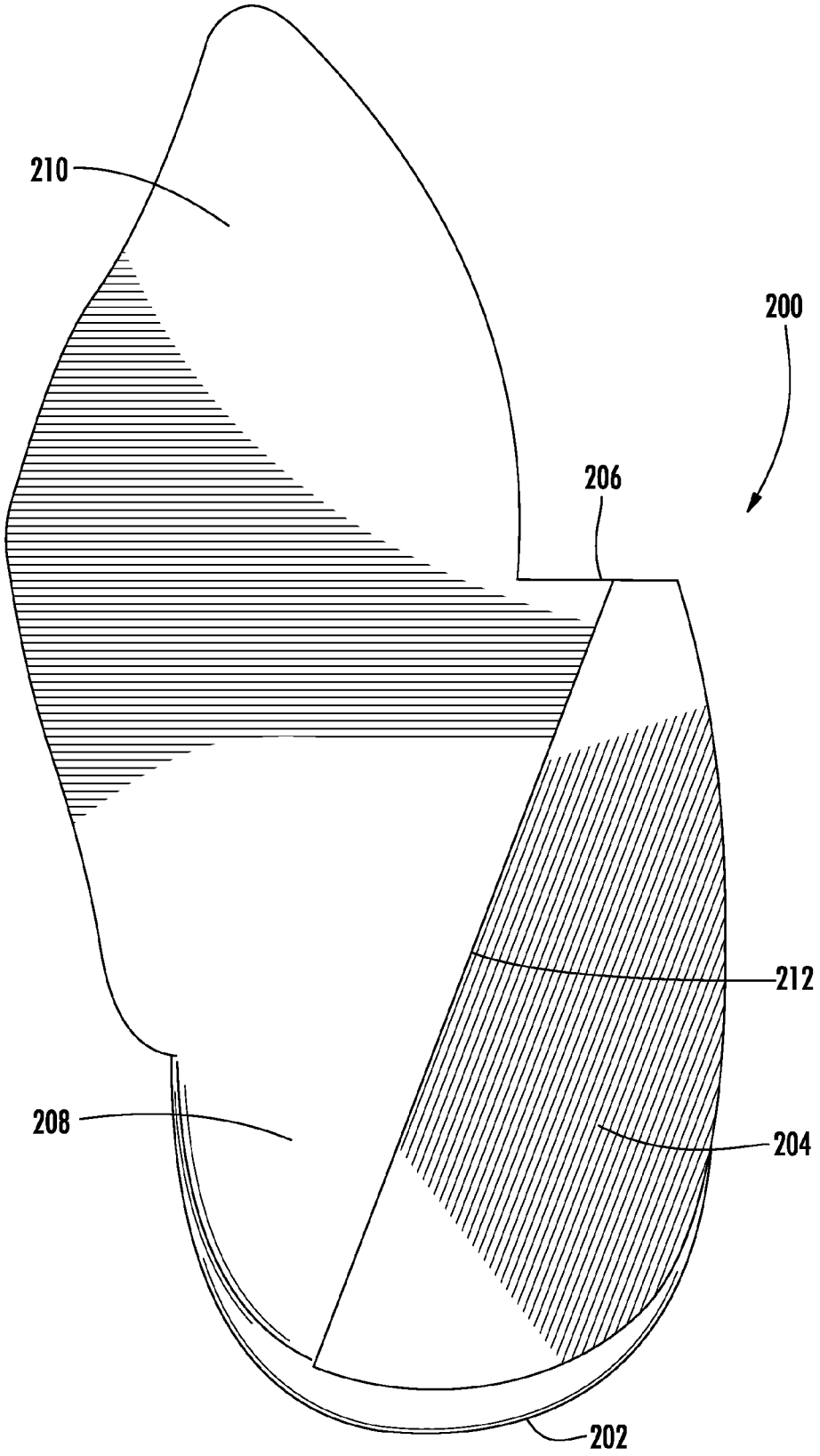
FIG. 10 depicts a bottom view of the exemplary left shoe insert.

FIG. 10 depicts a bottom view of the exemplary left shoe insert 200. The left lateral flange 204 may extend below the left heel cup 202. The left lateral flange 204 may primarily support approximately the outer or lateral half 206 of the left shoe insert, and only provide limited support to the inner or medial half 208 of the left shoe insert, such as provide limited support to the medial half 208 in the vicinity of the back of the left heel. In one embodiment, the left lateral flange 204 may primarily support a left, rear corner of the left foot.

The left lateral flange 204 may be configured to be at an angle 212 (or taper) with respect to the longitudinal axis of the left shoe insert 200 when viewed from above. The angle 212 may be approximately 10 degrees, 15 degrees, 20 degrees, 25 degrees, or other angles.

Moving forward from the back of the left heel, the inclined slope or angle 212 may move from the medial half 208 (near the rear of the left heel) first toward and then into the lateral half 206. Once away from the back area of the left heel, the left lateral flange 204 may be entirely on the lateral half 206 and support the majority, but not the entirety, of the lateral half 206. For instance, the inner, forward most portion of the lateral half 206 may not be supported by the left lateral flange 204, as shown in FIG. 10. Alternatively, the inclined slope or angle 212 may be at zero degrees and be parallel to the longitudinal axis of the left insert 200. For example, the inclined slope or angle 212 may divide the left insert 200 and separate the medial half 208 and the lateral half 206, and the left lateral flange 204 may only support all, or part of, the lateral half 206, but not support any portion of the medial half 208. Other configurations may be used.

Figure 11:
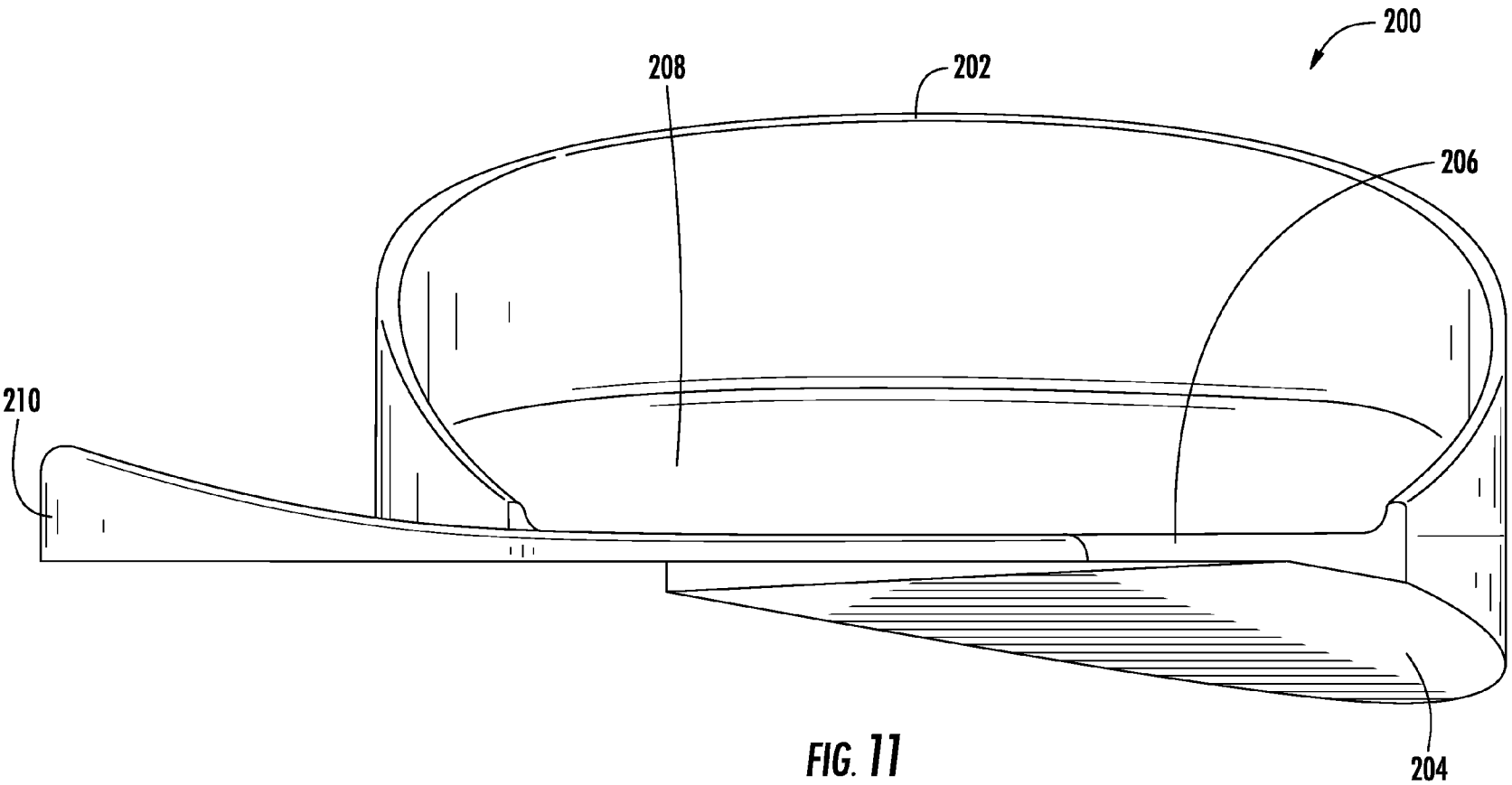
FIG. 11 depicts a front view of the exemplary left shoe insert.

FIG. 11 depicts a front view of the exemplary left shoe insert 200. The left heel cup 202 may be curved to surround or support the lateral half 206 and the medial half 208, and the back of the left heel during use. The left lateral flange 204 may extend below and underneath the left shoe insert 200, and primarily, or even only, support approximately the lateral or outer half 206. The left lateral flange 204 may be sloped or downwardly inclined both moving from the back end of the left shoe insert 200 toward the toes of the left foot, and moving from the outside of the left foot toward the middle and/or inside of the left foot.

The medial arch portion 210 may be wedged-shaped. The medial arch portion 210 may include a slope or downward incline moving from the inside of the left foot toward the middle of the left foot.

Figure 12:
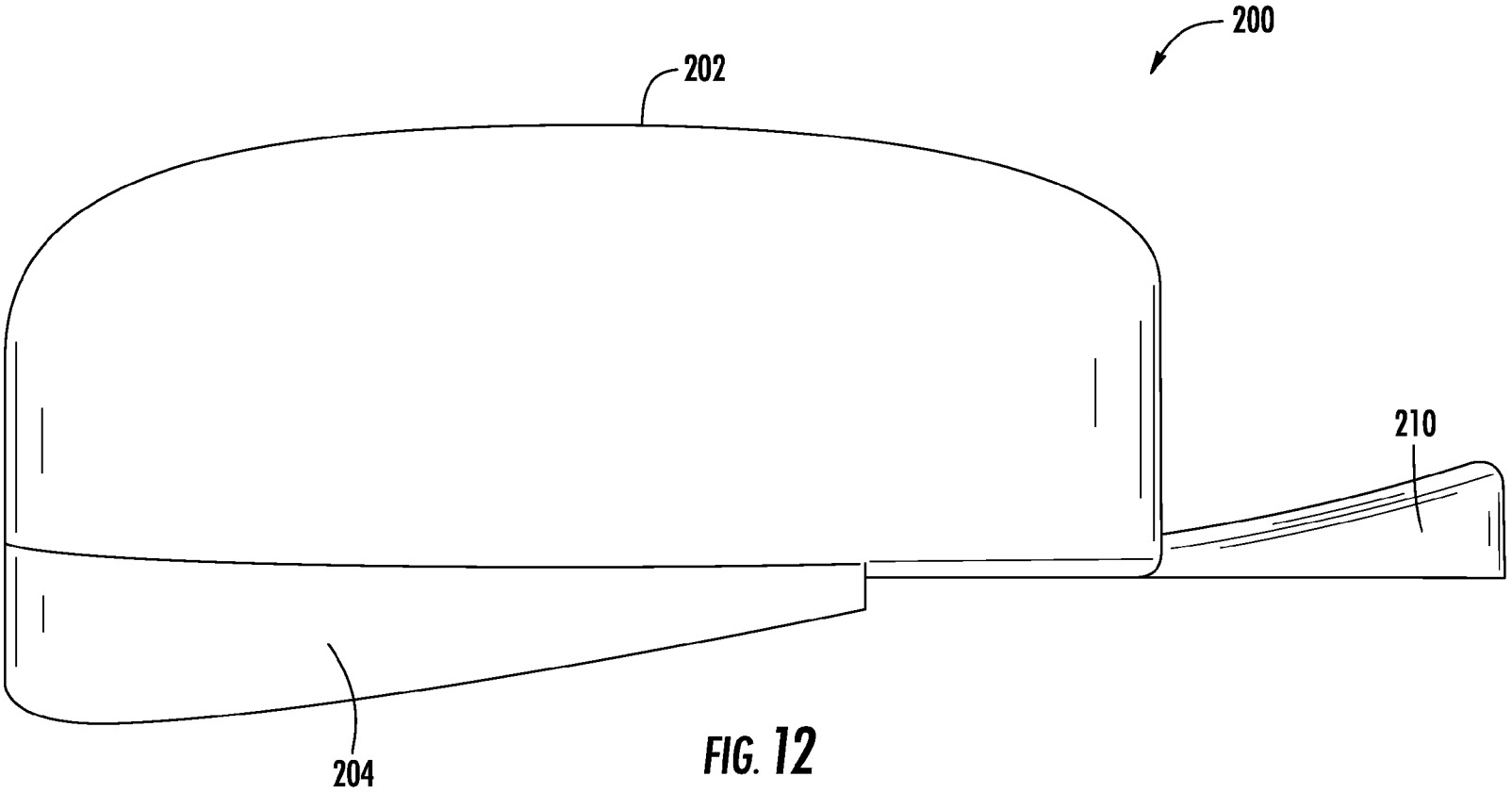
FIG. 12 depicts a back view of the exemplary left shoe insert.

FIG. 12 depicts a back view of the exemplary left shoe insert 200. The left lateral flange 204 may extend below the left heel cup 202 and primarily support the lateral side of the left foot. As shown, at the rear of the left heel, the left lateral flange 204 may extend into the inside or medial half of the left foot. The medial arch portion 210 may extend more inwardly (with respect to the inside of the left foot) than the left heel cup 202 and be wedged-shaped to provide arch support to the player during use.

In one embodiment, the left shoe insert 200 may have a maximum width of approximately 2.6 inches. The left lateral flange 204 may have approximately a 10 degree downward slope. The left lateral flange 204 may have a greatest width of approximately half the maximum width of the left shoe insert 200, such as approximately 1.3 inches. Alternatively, the left lateral flange 204 may be inclined or sloped moving longitudinally with respect to the left shoe insert (such as shown in FIG. 10). The vertical height of the left heel cup 202 at the back of the left heel may be approximately 1.15 inches, and the vertical height or thickness of the left lateral flange 204 at the outer edge of the left shoe insert 200 may be approximately 0.23 inches. As a result, the left heel cup 202 and the left lateral flange 204 may have a maximum total vertical height of approximately 1.38 inches at the outer edge of the left foot. Other dimensions may be used.

Figure 13:
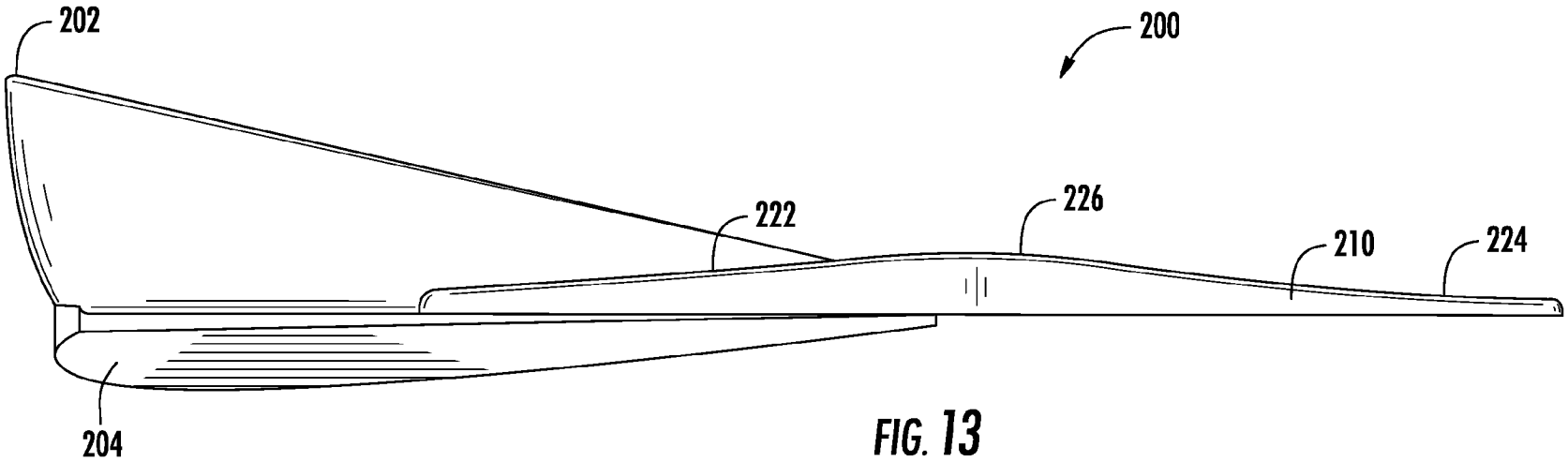
FIG. 13 depicts a right view of the exemplary left shoe insert.

FIG. 13 depicts a right view of the exemplary left shoe insert 200. The left heel cup 202 and the left lateral flange 204 may have approximately the same longitudinal length. The medial arch portion 210 may extend past the forward ends of both the left heel cup 202 and the left lateral flange 204. The medial arch portion 210 may rise at a slight up angle 222 moving in a forward direction (i.e., from the back of the heel toward the toes) to approximately a mid-point 226 of the medial arch portion 210. Then the medial arch portion 210 may decline at a slight down angle 224 from the mid-point 226 of the medial arch portion 210 to the forward most end of the medial arch portion 210. The slight up angle 222 and the slight down angle 224 may be between approximately 1 degree and approximately 30 degrees, or at other degrees. The medial arch portion 210 may include additional, fewer, or alternate shapes and features.

In one embodiment, the medial arch portion 210 may have a longitudinal length of approximately 5.1 inches. The back end of the medial arch portion 210 nearest the left heel may be approximately 1.7 inches from the back of the left heel cup 202. The medial arch portion 210 may be triangular and wedged-shaped, or alternatively rounded and curved like a speed bump. The medial arch portion 210 may have a height of between approximately 0.08 inches and approximately 0.9 inches, or between approximately 0.6 inches and approximately 0.8 inches. The medial arch portion 210 may extend past the front end of the left heel cup 202 by approximately 2.8 inches. The left lateral flange 204 may have a vertical height or thickness of approximately 0.23 inches at the back of the heel, and the thickness may decline to approximately 0.08 inches at the front of the left shoe insert 200. Other dimensions may be used.

Figure 14:
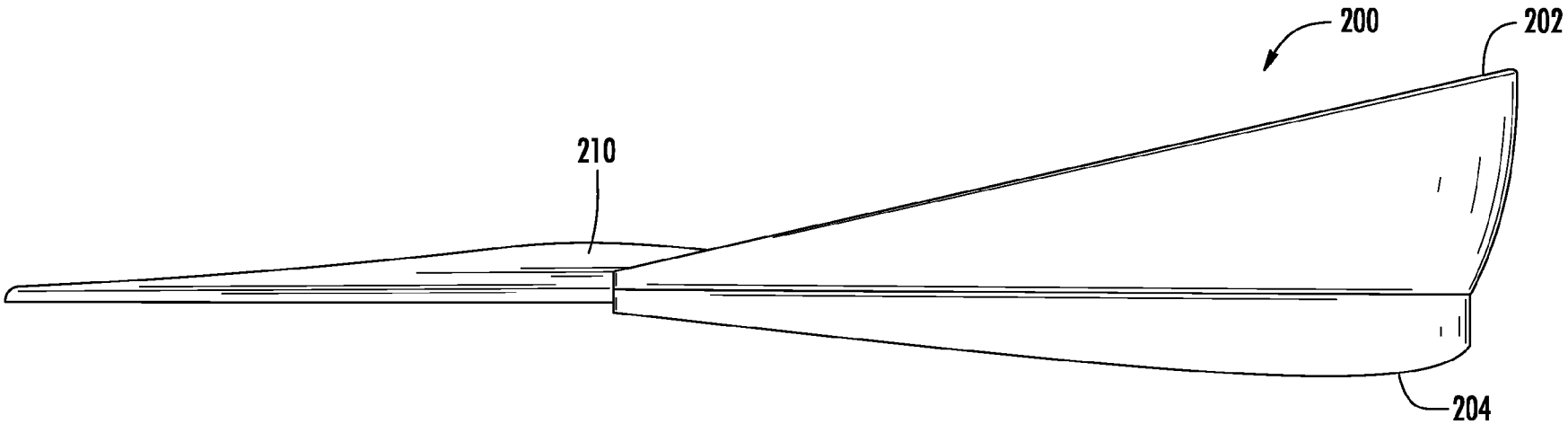
FIG. 14 depicts a left view of the exemplary left shoe insert.

FIG. 14 depicts a left view of the exemplary left shoe insert 200. The left lateral flange 204 may extend below the left heel cup 202. The medial arch portion 210 may extend forward of the left lateral flange 204. The medial arch portion 210 may include a triangular wedge-shape to provide arch support to the left foot.

III. Additional Exemplary Embodiments

Figure 15:
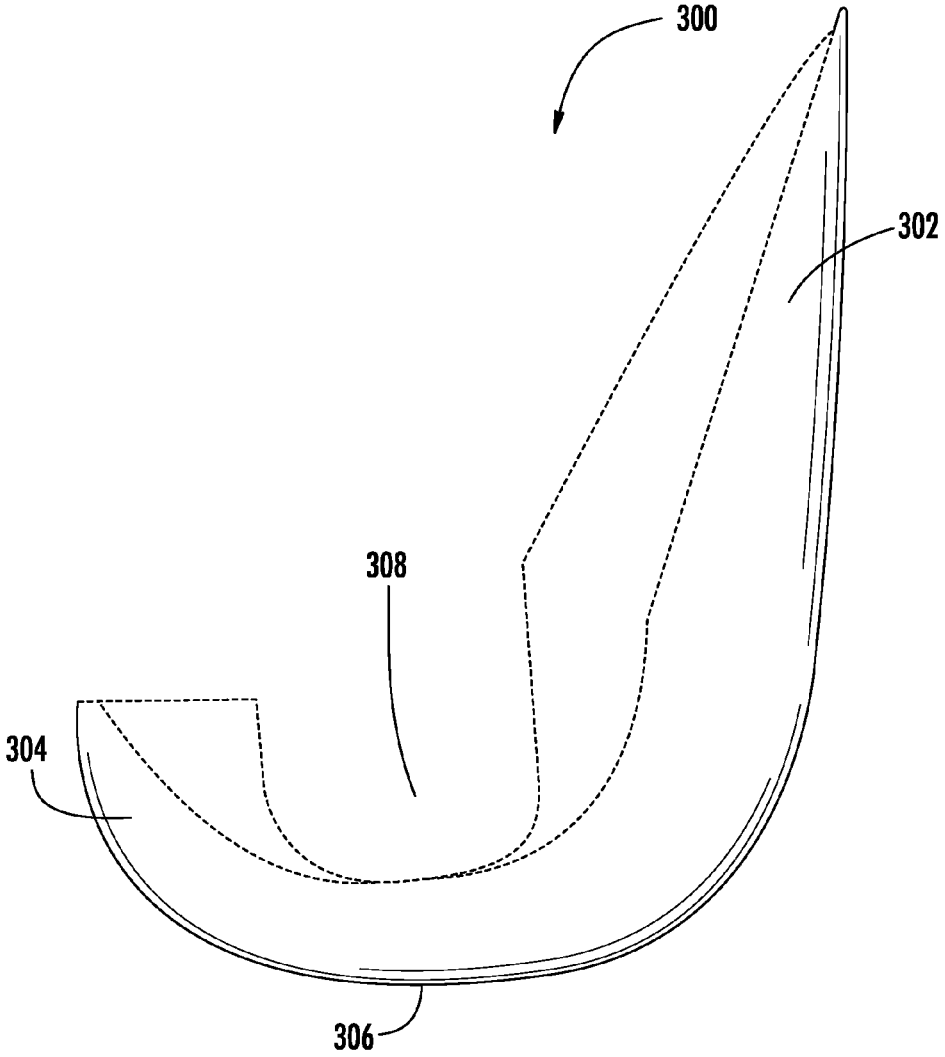
FIG. 15 depicts a top view of another exemplary right shoe insert.

FIG. 15 depicts a dorsal view of another exemplary right foot insert 300. The right foot insert 300 may include a lateral flange 302, a medial portion 304, and a heel cup or portion 306. The right foot insert may include additional, fewer, or alternate components.

Assuming that the golfer or other player is a right-handed swinger, the insert 300 for the right foot may include a lateral (outer side of the foot) flange 302 that extends along the outside of the right foot from the heel, or the vicinity thereof, to the base, or approximately the base, of the $5^{th}$ metatarsal. The lateral flange 302 may be tapered or narrowing moving from the heel toward the toes. The taper may be at various angles. For instance, the lateral flange 302 may have a taper of approximately 10 degrees, approximately 15 degrees, approximately 20 degrees, or other angles when viewed from above.

The medial portion 304 may extend along the inside of the right foot from the back of the heel to the vicinity of the right ankle, such as to approximately the front, back, or middle of the heel and/or ankle area. The size of the medial portion 304 may be limited, and have no or substantially no medial heel cup and/or medial flange to allow right heel and/or ankle rolling movement during use. For instance, the heel cup 306 may not extend past approximately the right ankle or approximately the front of the right ankle on the inside of the right foot.

The middle of the bottom of a player's heel may be uncovered or not supported by the right foot insert or heel cup 306. Instead, the middle of the bottom of a player's heel may fit within an empty area 308 of the right foot insert 300.

The heel cup 306 may have a maximum vertical height of approximately 0.8 inches, such as at the back of the heel. The height may be constant or sloping downward moving from the lateral to medial side of the foot. Other heights and configurations may be used.

The lateral flange 302 may have a lateral to medial downward slope that runs the entire width of the heel (from the lateral to medial side of the right foot), or that runs approximately half of the width of the heel (from the lateral side to approximately the mid-point of the right foot). In one embodiment, the slope of the lateral flange 302 moving across the width of the right foot may be approximately 20 degrees downward. The lateral flange may also slope down, such as by approximately 0.08 inches or other distance, moving from the back of the heel toward the toes. Other degrees and slope amounts may be used.

Figure 16:
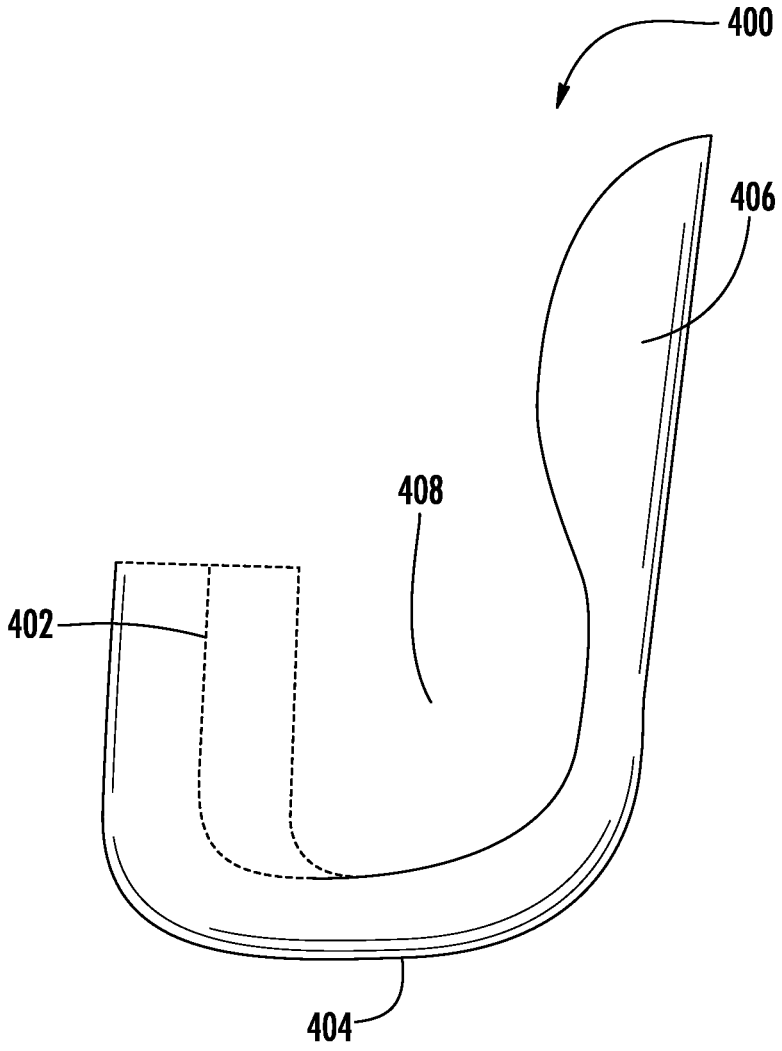
FIG. 16 depicts a top view of another exemplary left shoe insert.

FIG. 16 depicts another exemplary left shoe insert 400. The left shoe insert 400 may include a left lateral flange 402, a left heel cup 404, a medial arch 406, and an unsupported area 408. The left shoe insert 400 may include additional, fewer, or alternate components.

The left lateral flange 402 may have approximately a 10 or other degree downward slope moving inward from the lateral side of the left foot toward the medial side. The left lateral flange 402 may also have a downward slope moving from the back of the heel toward the toes. The downward slope may cover approximately 0.08 inches or other amount of downward movement. The left heel cup 404 may have a mid-height of approximately 0.8 inches or other amounts. The heel of the left foot insert 400 may be uniform and/or of the same height moving across the rear of the left foot.

The medial arch 406 may provide arch support and for greater contact with the ground on backswing and follow through. As a result, the left foot insert 400 may have a medial support portion 406 (on the inner side of the foot) that extends past the lateral flange 402 (on the outer side of the foot). The medial arch 406 may be curved upward and inward. The left shoe insert 400 may optionally include an uncovered central area 408 that may facilitate rolling movement and support during use. Other configurations may be used.

IV. Exemplary Uses

In addition to golf, the left and right shoe inserts of the present embodiments may be used (1) in their current design for baseball and softball, (2) incorporating a modification of adding a medial flange to the right foot for racquet sports (including tennis, badminton, squash, racquetball, and handball) and lateral cutting sports (soccer, volleyball, lacrosse), or (3) for football and basketball by making use of the varus wedge (lateral flange) for injury prevention and post injury (ankle sprains). Moreover, the inserts may have a place in the rehabilitation of ankle sprains and the clinical practice of medicine for not only those sprains but for rearfoot varus foot types in daily shoe wear.

The left and right shoe inserts may also be used during baseball and softball games. Much like a golfer, the hitter may generate bat speed using a kinetic link. Consequently, a large part of a hitter's mechanical performance may be derived from maximizing the kinetic link parameters. The actions of the rear leg before bat-ball contact may be important to the success of the overall swing.

Hypothesized, the straighter the back leg at contact reflects the ability of the hitter to transfer momentum from the lower body effectively. Therefore, the straighter the rear leg, the greater hip rotation and increase in force production through the trunk, arms and bat may lead to increased bat velocity. Stability (such as a straight leg) may be supported by the lateral flange of the right foot device. No medial arch on the right foot insert may allow for follow through of rear foot/leg. The deep heel cup may allow for support and prevent heel slippage. In addition to hitters, pitchers may have an increased demand for push off of the rear leg, which may be accomplished by a rigid sole to shoe or lateral flange.

The left and right shoe inserts may further be used during racquet and/or court sports. For injury prevention, court shoes may need to be stable to counter excessive pronation (medial flange/arch support) and especially excessive supination involving sideward cutting movements (lateral flange), the latter of which is common to court sports. To reduce risk of injury from excessive supinatory motion, shoes with high/high mid top quarter height and firm heel counters may help, in addition to external devices such as ankle bracing.

But to be effective in reducing injury, these features preferably reduce inversion moments immediately after touchdown as shoe inversion takes place, such as within 40 milliseconds after touchdown. The insert thus may be more comfortable than an external brace/high top shoes, and more effective as it is in direct contact with shoe and foot, and able to be reactive in the 40 millisecond period of time necessary.

Most lower extremity injuries may occur on surfaces with high translational traction such as asphalt, concrete, etc. causing foot fixation/"blocking." The inserts, particularly the lateral flange, may prevent this.

From a performance perspective, players may be willing to sacrifice injury prevention for increased traction—which is a factor that should be considered. So players may use the inserts to get increased traction rather than from the shoe itself; preventing the foot fixation that occurs from using a shoe with higher translational traction, such as gum rubber. Performance may also be improved by minimizing energy loss, which may be achieved by using appropriate cushioned materials (silicone) to minimize soft tissue vibrations (decreases the need for muscle dampening) and stabilizing the ankle (limits the need for internal muscle stabilization).

The right and left shoe inserts may be used while playing football, basketball, or other games that involve cutting and change in the direction of player movement. The varus wedge portion of the inserts (lateral flange) may be helpful for certain position players/sports that incorporate lateral cutting motions (i.e., running backs, basketball players) that are trying to return from acute ankle sprain injury or have chronic history of ankle sprains for prevention. This may not only be more comfortable but more effective than the "spating" (outside tapping to cleats and ankle in football) or bulky ankle braces used in both sports.

The right and left shoe inserts may further be used during clinical practice. The shoe inserts may be used on a widespread daily basis as part of a conservative regimen for ankle sprains to go along with icing, physical therapy, and NSAIDs (nonsteroidal anti-inflammatory drugs). Additionally, certain varus foot types may benefit from their use as well.

In sum, the human body was not designed with golf or other sports in mind. The orthotics of the present embodiments that support and brace the right and left feet may compensate for that. Each orthotic may be a silicone, TPU, EVA, or polypropylene golf shoe insert designed to improve performance, and teach proper foot position to swing while helping to prevent injuries. Preferably, the left and right inserts are not similar to one another, and support different areas of the left and right foot, respectively.

The arrangements described herein are intended to provide a general understanding of the structure of various embodiments, and they are not intended to serve as a complete description of all the elements and features of apparatus and systems that might make use of the structures described herein. Many other arrangements will be apparent to those of skill in the art upon reviewing the above description. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

The invention claimed is:

1. A sport shoe insert system comprising a pair of sport shoe inserts, the system comprising:

a right insert configured to be inserted in a right shoe to partially support a right foot of a player wearing the right shoe during performance of a swing movement, the right insert extending along a longitudinal axis between a rear end and a front end and having a medial half and a lateral half with respect to the longitudinal axis, the right insert comprising a right heel area and a right lateral flange, the right heel area positioned along the rear end and is configured to support a right heel of the right foot during use, the right lateral flange positioned along the lateral half between the rear end, underlying the right heel area, and the front end of the insert, the right lateral flange extending between the rear end and the front end at an angle with respect to the longitudinal axis, the right lateral flange configured to primarily support the right half of the right foot, wherein, in use, the right lateral flange extends along the right half of the right foot from the back of the right heel of the right foot corresponding to the rear end of the right insert until approximately a base of a fifth metatarsal is reached corresponding to the front end along the lateral half of the right insert such that a forefoot area of the right foot is not supported by the right insert and the right lateral flange is configured to support the calcaneal-cuboid joint, and the right lateral flange having a first constant downward slope that corresponds to a decrease in a thickness of the right lateral flange moving in a lateral to medial direction and a second constant downward slope that corresponds to a decrease in the thickness moving in a rear to forward direction toward the base of the fifth metatarsal, wherein the right insert is configured such that, in use, on a left, back half of the right foot, the front end along the medial half of the right insert does not extend past approximately a front of a right ankle to provide a cleared medial area for the right foot that facilitates unhindered follow through and rolling movement of the right foot during a swing or other movement, and wherein the front end along the lateral half is positioned forward of the front end along the medial half; and a left insert configured to be inserted into a left shoe to partially support a left foot of a player wearing the left shoe during performance of a swing movement, the left insert extending along a longitudinal axis between a rear end and a front end and having a medial half and a lateral half with respect to the longitudinal axis, the left insert comprising a left lateral flange, a left heel area, and a medial arch support, the left lateral flange extending in a forward direction from the rear end of the left insert along the lateral half and configured to primarily support a left, back half of the left foot, and the left lateral flange having a first constant downward slope moving in a lateral to medial direction and a second constant downward slope moving from the rear end of the left insert to the forward end in a forward direction; and wherein both the right lateral flange and the left lateral flange are configured to facilitate moving weight of the player onto balls of the right foot and the left foot, respectively, and to improve balance of the player during a swing or other player movement.

2. The system of claim 1, wherein the first constant downward slope of the right lateral flange is approximately 20 degrees downward.

3. The system of claim 2, wherein the second constant downward slope of the right lateral flange covers approximately 2 mm in a downward direction such that the thickness of the right lateral flange decreases approximately 2 mm between the rear end to the front end of the right insert.

4. The system of claim 1, wherein the first constant downward slope of the left lateral flange is approximately 10 degrees downward.

5. The system of claim 4, wherein the second constant downward slope of the left lateral flange covers approximately 2 mm in a downward direction such that the thickness of the left lateral flange decreases approximately 2 mm between the rear end to the front end of the left insert.

6. The system of claim 1, wherein the right heel area of the right insert comprises a top surface that slopes in a downward direction moving forward to provide less support to an inward heel region of the right foot.

7. The system of claim 1, wherein the right heel area of the right insert extends forwardly from the rear end of the right insert only to approximately a front of a right ankle to provide less support to an inward heel region of the right foot and to facilitate rolling movement of the right ankle during the swing or other player movement.

8. The system of claim 1, wherein the medial arch support comprises a medial arch portion interconnected with the medial half to provide arch support to the left foot during use, the medial arch portion comprising a forward surface forward of the heel area, a rear surface adjacent to the heel area, and a right surface between the forward surface and the rear surface and positioned a greater distance right of the longitudinal axis than the forward surface and the rear surface, wherein the medial arch portion extends along a right side of the heel area, when viewed from above, between the rear surface and the right surface, and wherein the medial arch portion defines a lateral to medial inclined slope extending to the right surface and declined slopes extending from the right surface toward each of the forward and rear surfaces, and wherein the pair of sport shoe inserts facilitate rolling movement of the right foot during performance of a golf or other swing.

9. A sport shoe insert system comprising a pair of sport shoe inserts, the system comprising:

a right shoe insert configured to be inserted in a right shoe of a player to partially support a right foot or a right heel of a right-handed swinging player during performance of a swing movement, the right shoe insert extending along a longitudinal axis between a rear end and a front end, the right shoe insert comprising:

a lateral half;

a medial half;

a heel area positioned at the rear end along the lateral half and medial half; and a lateral flange positioned along the lateral half between the rear end, underlying the heel area, and the front end of the insert, wherein the lateral flange is configured to primarily support the right half of the right foot, wherein, in use, the lateral flange extends along the right half of the right foot from the back of the right heel of the right foot corresponding to the rear end of the insert until approximately a base of a fifth metatarsal is reached corresponding to the front end along the lateral half of the right insert such that a forefoot area of the right foot is not supported by the right insert and the lateral flange is configured to support the calcaneal-cuboid joint, and wherein the lateral flange defines a first constant downward slope that corresponds to a decrease in a thickness of the lateral flange moving in a lateral to medial direction and a second constant downward slope that corresponds to a decrease in the thickness moving in a rear to forward direction toward the base of the fifth metatarsal; and a left shoe insert configured to be inserted in a left shoe to partially support a left foot or a left heel of a right-handed swinging player during performance of a swing movement, the left insert comprising:

a lateral half;

a medial half;

a heel area positioned along a rear end of the lateral half and the medial half;

a left lateral flange interconnected with the heel area and forwardly extending along the lateral half from the rear end to a front end of the lateral half of the left shoe insert, wherein the left lateral flange has a first constant downward slope moving in a lateral to medial direction, and a second constant downward slope moving in a forward direction from the rear end to the front end of the lateral half of the left shoe insert, and wherein the left lateral flange is configured to primarily support a lateral half of the left foot when viewed from above; and a medial arch portion interconnected with the medial half to provide arch support to the left foot during use and including, the medial arch portion comprising a forward surface forward of the heel area, a rear surface adjacent to the heel area, and a right surface between the forward surface and the rear surface and positioned a greater distance right of the longitudinal axis than the forward surface and the rear surface, wherein the medial arch portion extends along a right side of the heel area, when viewed from above, between the rear surface and the right surface, and wherein the medial arch portion defines a lateral to medial inclined slope extending to the right surface and declined slopes extending from the right surface toward each of the forward and rear surfaces.

10. The system of claim 9, wherein the lateral half and the medial half of the right insert forwardly taper away from the rear end of the insert to facilitate moving weight of a wearer onto a ball of the right foot and improve balance during the performance of the swing or other movement, wherein the second downward slope and the taper of the lateral half of the right insert coextend to reduce a thickness of the lateral half in the forward direction between the rear end and the forward end of the insert along the lateral half, wherein the front end along the medial half of the right insert does not extend past approximately a front of the right ankle of the player to provide a cleared medial area for the right foot that facilitates unhindered follow through and rolling movement of the right ankle during a swing by the player, and wherein the front end along the lateral half of the right shoe insert is positioned forward of the front end along the medial half of the right insert.

11. The system of claim 10, wherein the rear end of the right insert comprises a thickness of approximately 2 mm.

12. The system of claim 9, wherein the heel area of the right insert includes a heel cup configured to substantially surround a back and sides of a right heel of the right foot during use, and wherein the heel area of the left insert includes a heel cup configured to substantially surround a back and sides of a left heel of the left foot during use.

13. The system of claim 1, wherein the right heel area includes a right heel cup configured to substantially surround a back and sides of a right heel of the right foot during use, and wherein the left heel area includes a left heel cup configured to substantially surround a back and sides of a left heel of the left foot during use.

* * * * *